US008596019B2

(12) United States Patent
Aitken

(10) Patent No.: US 8,596,019 B2
(45) Date of Patent: Dec. 3, 2013

(54) DRYWALL TRACK SYSTEM

(76) Inventor: Douglas Aitken, Woodbury, NJ (US)

( * ) Notice: Subject to any disclaimer, the term of this patent is extended or adjusted under 35 U.S.C. 154(b) by 4 days.

(21) Appl. No.: 13/497,327

(22) PCT Filed: Oct. 11, 2010

(86) PCT No.: PCT/US2010/052155

§ 371 (c)(1),
(2), (4) Date: Apr. 2, 2012

(87) PCT Pub. No.: WO2011/046862

PCT Pub. Date: Apr. 21, 2011

(65) Prior Publication Data

US 2012/0174513 A1 Jul. 12, 2012

Related U.S. Application Data

(60) Provisional application No. 61/251,062, filed on Oct. 13, 2009.

(51) Int. Cl.
*E04B 1/38* (2006.01)

(52) U.S. Cl.
USPC ..... 52/710

(58) Field of Classification Search
USPC ..... 52/302.1, 302.3, 220.8, 698, 703, 708, 52/710, 711, 712, 715
See application file for complete search history.

(56) References Cited

U.S. PATENT DOCUMENTS

| | | | | |
|---|---|---|---|---|
| 5,079,884 | A | 1/1992 | Menchetti | |
| 5,836,135 | A * | 11/1998 | Hagan et al. | 52/836 |
| 6,293,064 | B1 * | 9/2001 | Larson | 52/302.1 |
| 6,298,609 | B1 * | 10/2001 | Bifano et al. | 52/58 |
| 6,470,638 | B1 * | 10/2002 | Larson | 52/302.1 |
| 7,712,267 | B2 * | 5/2010 | Lehane et al. | 52/169.5 |
| 7,861,470 | B2 * | 1/2011 | Lehane et al. | 52/169.5 |
| 2005/0183361 | A1 * | 8/2005 | Frezza | 52/293.3 |
| 2005/0229515 | A1 * | 10/2005 | Ruston | 52/302.6 |
| 2006/0054419 | A1 * | 3/2006 | Friedman et al. | 187/211 |
| 2007/0163191 | A1 * | 7/2007 | Berry | 52/281 |
| 2009/0064631 | A1 * | 3/2009 | Frezza | 52/745.09 |

* cited by examiner

*Primary Examiner* — William Gilbert
*Assistant Examiner* — Gisele Ford
(74) *Attorney, Agent, or Firm* — Woodcock Washburn LLP

(57) ABSTRACT

The present invention is direction to systems for assembling drywall tracks that support drywall above the floor.

14 Claims, 3 Drawing Sheets

DRYWALL TRACK SYSTEM

CROSS REFERENCE TO RELATED APPLICATIONS

This application is the National Stage of International Application No. PCT/US2010/052155 filed Oct. 11, 2010, which claims the benefit of U.S. Provisional Patent Application No. 61/251,062, filed Oct. 13, 2009, the entireties of which are incorporated herein.

TECHNICAL FIELD

The present invention is directed to improved drywall track systems that support drywall above the floor surface.

BACKGROUND

Stud framing is commonplace in both commercial and residential construction. Typically, a track is mounted to the ceiling and/or floor and studs are inserted into and attached to the track using, for example, screws or nails. Once the studs are installed, a wall is formed by attaching drywall, also known in the art as gypsum board, to the studs.

Drywall is very absorbent and will tend to wick any moisture with which it comes in contact. This is undesirable because moist drywall can harbor and grow toxic mold. Once mold has contaminated drywall, it is very costly to eliminate, often requiring that the affected drywall be removed, discarded, and replaced with new drywall.

In order to avoid this problem, installers will tend to position the drywall so that its lower edge is above the floor surface so as to avoid the wicking of any moisture from the floor. Some methods of accomplishing this use tracks that have been adapted to include a ledge or support within the track that props the drywall above the floor surface. See, e.g., U.S. Published patent application Nos. 2007/0163191; 2005/0183361. But while these prior art systems would satisfactorily support the drywall above the floor surface, they are not practicable for the commercial and residential construction business because their irregular shape often does not permit compact stacking of the track for shipping and storage. As a result, these irregularly shaped tracks will consume more storage and shipping space, leading to increased costs.

Thus, drywall track systems that support drywall above the floor, while being capable of compact stacking during shipping and storage are needed.

SUMMARY

The present invention is directed to systems for forming drywall track comprising at least two components that are stackable within each other. Each component of the invention consists essentially of a base section that is substantially perpendicular to a lateral section. The lateral section includes a niche portion that is adapted for supporting drywall above the base section, preferably by at least 0.5 inches. The base section of each component is configured such that the base sections of the two components can be connected such that the components are in opposing relation to each other to form the drywall track.

BRIEF DESCRIPTION OF THE DRAWINGS

FIG. 3A depicts one embodiment accommodating a 2×4 stud. FIG. 3B depicts one embodiment accommodating a 2×6 stud.

DETAILED DESCRIPTION OF ILLUSTRATIVE EMBODIMENTS

Figure 2A:
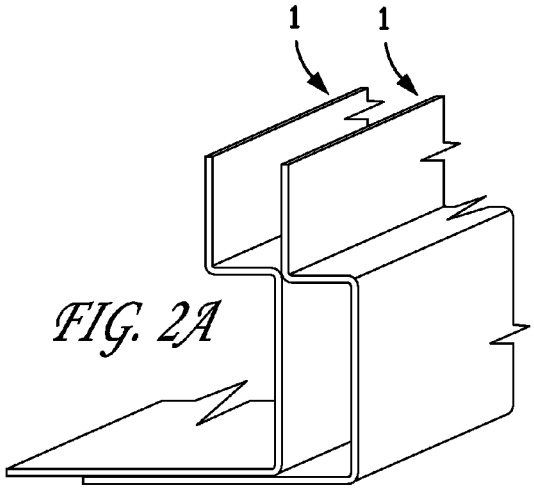
FIG. 2A depicts one embodiment of the present invention wherein two components are stacked within each other.
Figure 2B:
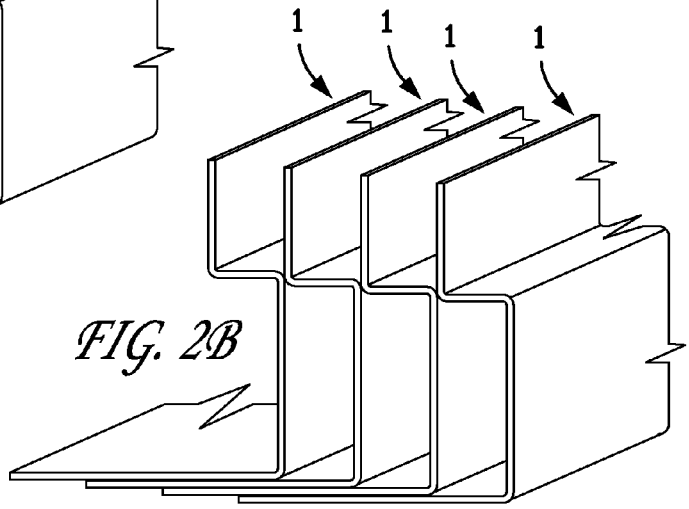
FIG. 2B depicts one embodiment of the present invention wherein four components are stacked within each other.

The present invention is directed to a system for forming drywall track that can support drywall above the floor. While other drywall track systems have been reported as having functionality capable of supporting drywall above the floor, those drywall tracks are described as a single unit. The systems of the present invention preferably include at least two components, which are generally narrower than the single units of the prior art, but are stackable within each other. The stackability of the components of the invention facilitates the shipping and storage of the components, as stacking reduces the overall volume of the components, hence leading to decreased shipping and storage costs. FIGS. 2A and 2B. Once the drywall track of the present invention is assembled, it can be used in any fashion known to those skilled in the art for installing drywall and forming walls and partitions.

The present invention can be further illustrated by reference to the accompanying figures. These figures are illustrative only, and are not intended to limit the scope of the invention.

Figure 1:
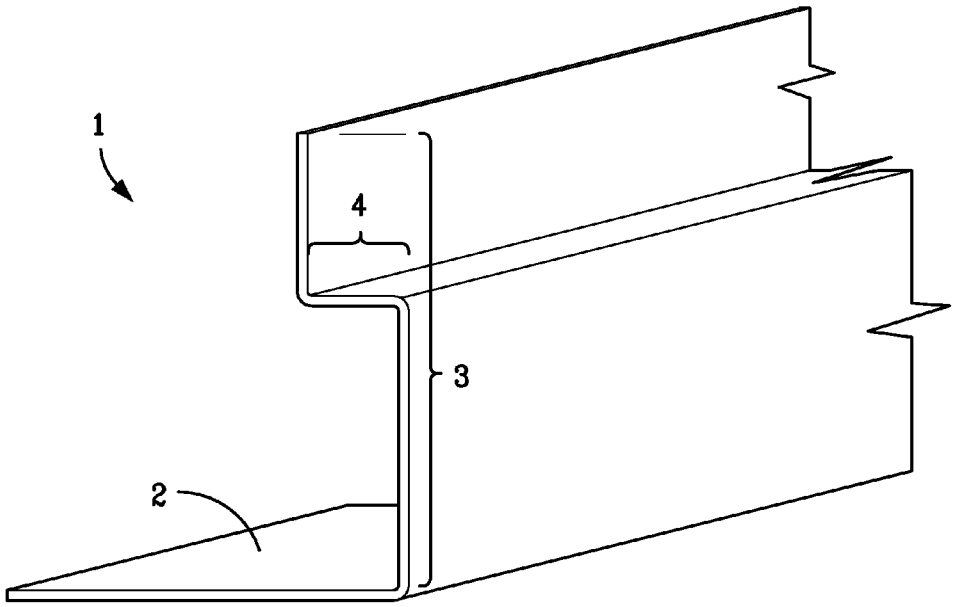
FIG. 1 depicts component of one embodiment of the present invention.

As depicted in FIG. 1, each component (1) of the system consists essentially of a base section (2) and a lateral section (3), with the base section being substantially perpendicular to the lateral section. The components of the invention can be fabricated from any materials suitable for use in drywall application. Preferably, the components are fabricated from a metal such as steel.

The lateral section includes a niche portion (4) that is adapted for supporting drywall (12, FIGS. 3A and 3B) above the base section, and hence the floor, preferably, by at least 0.5 inches above the base section. The niche must be of such a depth so as to accommodate at least one sheet of drywall. Commercially available drywall is typically about 0.5 inches or ⅝ in. thick; therefore, for such applications, the niche must be at least about 0.5 inches or at least about ⅝ in., deep to support a standard drywall sheet. It is envisioned that the systems of the invention can be adapted to accommodate more than one sheet of drywall, or thicker sheets of drywall, by increasing the depth of the niche accordingly.

The niche must also be positioned within the lateral section such that drywall seated upon it will be supported above the base section, and hence, the floor. The niche should be positioned such that drywall seated on it is preferably at least 0.5 in. above the base section. More preferably, the niche is positioned such that drywall seated is at least about 1 in. above the base section. In other embodiments, the niche is positioned such that drywall can be about 1.5 inches, about 2 inches, or higher in some construction situations.

Figure 3A:
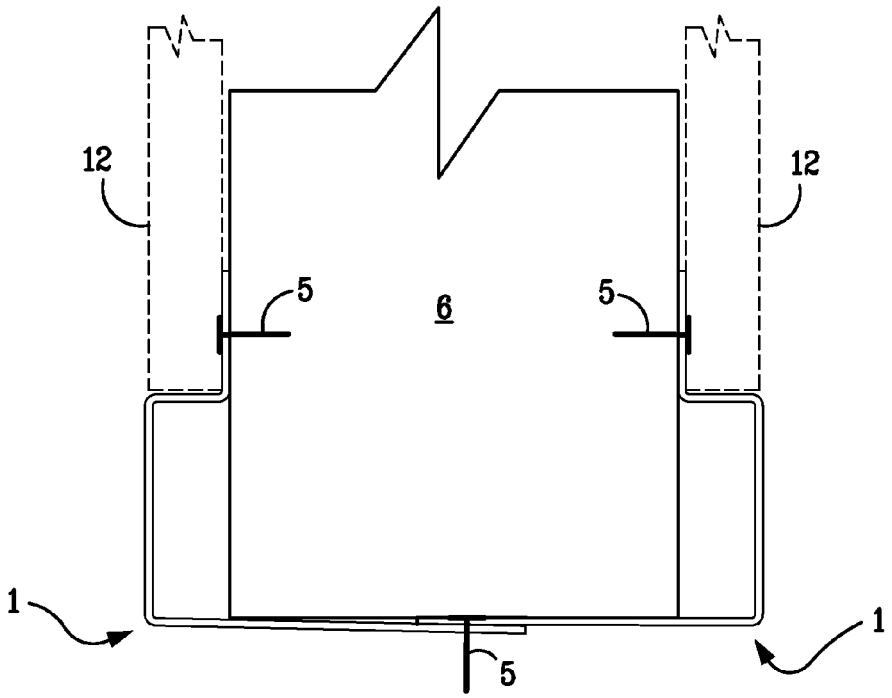
FIGS. 3A and 3B depict embodiments of the present invention demonstrating the adjustability of the system.
Figure 3B:
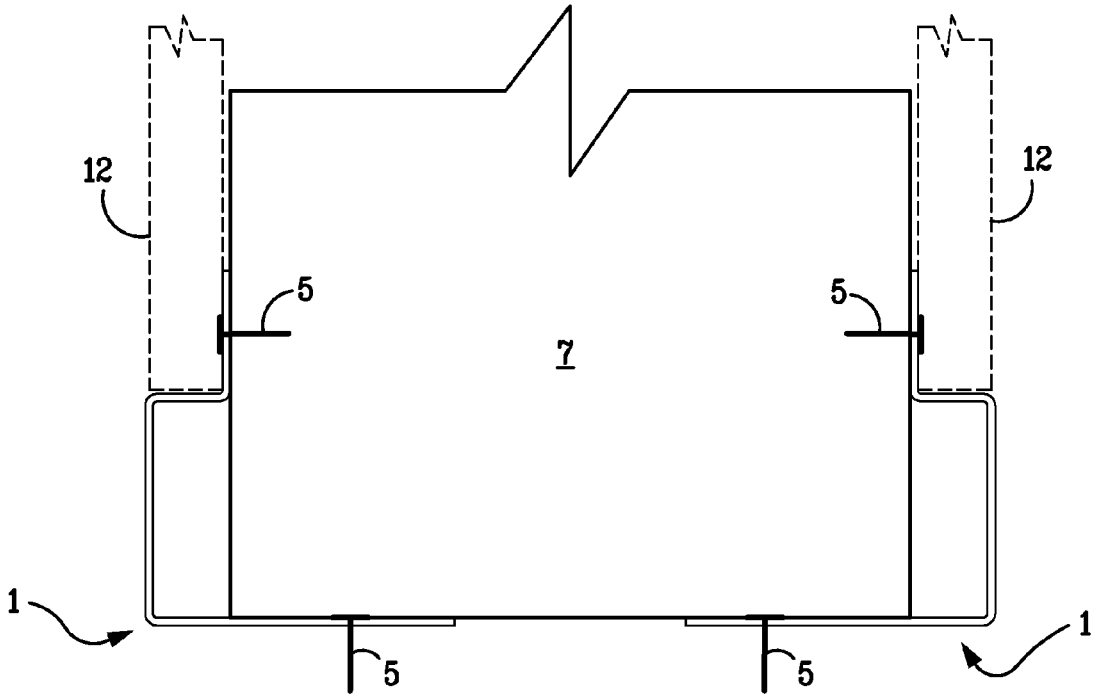

The base section of each component is configured such that the base sections of the two components can be connected such that the components are in opposing relation to each other to form the drywall track. See, e.g., FIGS. 3A and 3B. In some embodiments, the base sections are connected such that the base sections abut each other. In certain embodiments, the base sections can be joined together to form the drywall track. For example, in some embodiments, one base section is positioned over another base section and the two components are then joined together using any fastener (5) known to those skilled in the art, as shown in FIGS. 3A and 3B. Preferred fasteners include nails, bolts, and screws.

In certain preferred embodiments of the invention, the base sections are complementarily sized such that the width of the drywall track can be adjusted by sliding one base section over a second base section. In these embodiments, the drywall track can be adjusted to accommodate 2×3 studs, 2×4 studs (6) or 2×6 studs (7), for example. FIGS. 3A and 3B. It is envisioned that any width can be accommodated by sliding the components closer together or farther apart. Once the desired width is achieved, the base sections are joined together or otherwise affixed using any fastening means known in the art.

Figure 4:
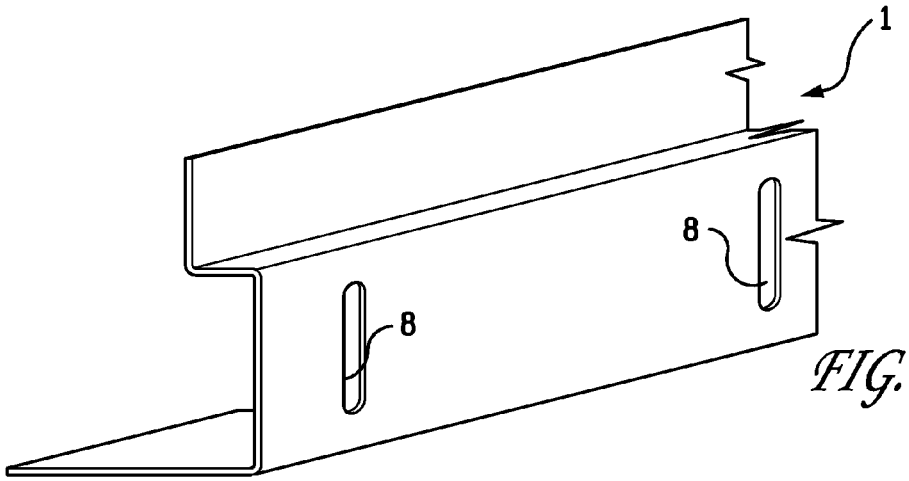
FIG. 4 depicts a component of one embodiment of the invention including vents.

The components of the system may also include at least one vent (8) to allow for air circulation through the system. These vents can be located on either the base section or the lateral section of the component. Preferably, the vent is located on the lateral section. Even more preferably, the vent is located below the niche portion of the lateral section. The vents can be of any size or shape, but preferably the vent is an elongated opening in the component. FIG. 4.

Figure 5A:
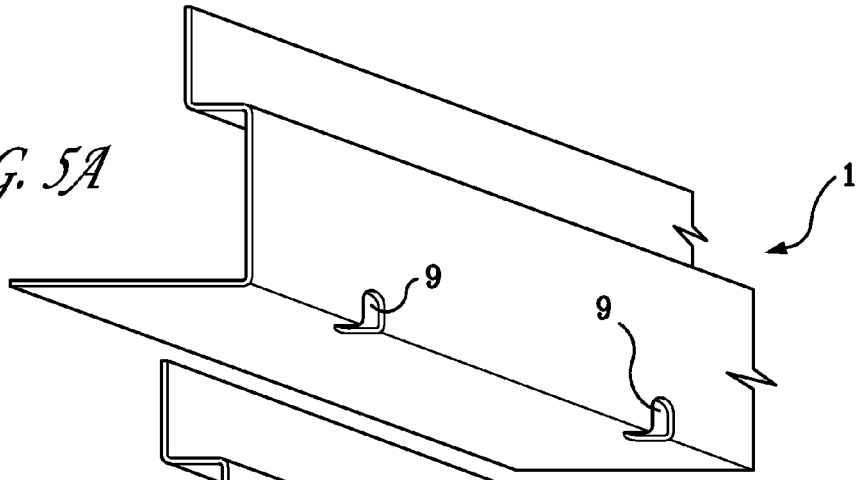
FIGS. 5A, 5B, and 5C depict embodiments of the invention including drainage apertures.
Figure 5B:
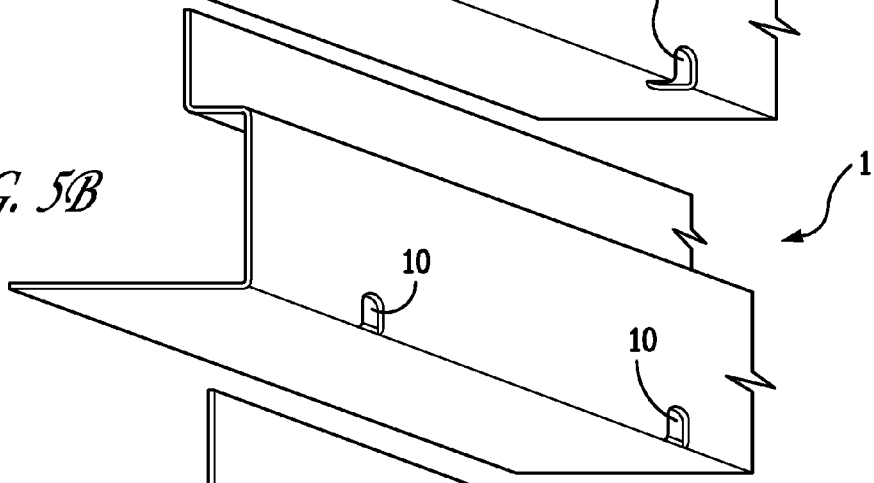
Figure 5C:
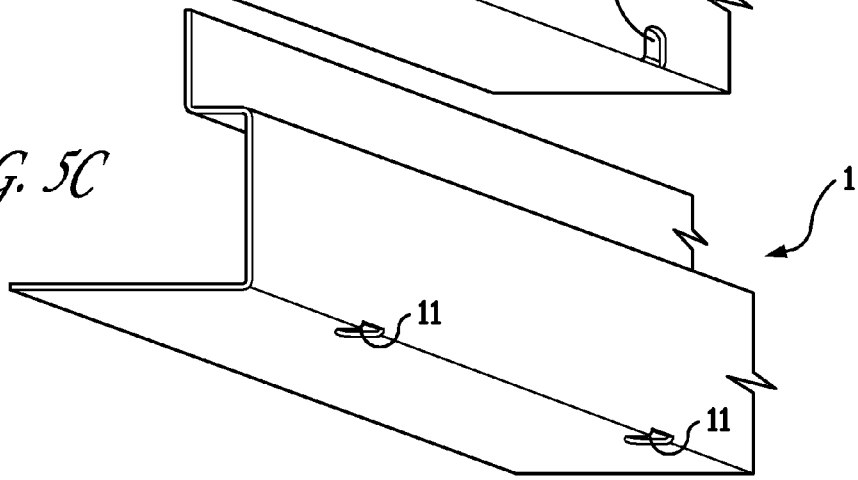

The components of the system may also include at least one drainage aperture. The inclusion of a drainage aperture is convenient in the event water, or some other liquid, enters the system. In such instances, the drainage aperture would provide a convenient means for the liquid to drain out of the system. The drainage aperture will preferably be located so that at least part of the aperture is on the base section of the component. In preferred embodiments, the drainage aperture (9) is located at the junction between the base section and the lateral section and is at least partially in both sections. FIGS. 5A, 5B, and 5C. In other embodiments, the drainage aperture (10) is located primarily on the lateral portion of the component. In still other embodiments, the drainage aperture (11) is located primarily on the base section.

The components of the systems of the invention can be of any desired length. Preferred lengths of the components are 8 feet, 10 feet, 12 feet, and 16 feet.

Also within the scope of the invention is the use of only one component of the described system as a drywall track. See FIGS. 1, 4, 5A, 5B, and 5C. In these embodiments, the drywall track consists essentially of a base section substantially perpendicular to a lateral section, the lateral section including a niche portion adapted for supporting drywall above the base section. Preferably, the drywall track consists of a base section substantially perpendicular to a lateral section, the lateral section including a niche portion adapted for supporting drywall above the base section. These embodiments may also include vents and/or apertures as described above.

The foregoing description is meant to be illustrative, and is not intended to be limiting of the invention.

What is claimed:

1. A system for forming drywall track comprising:

at least two components that are stackable within each other, each component consisting of:

a single planar base section substantially perpendicular to a single, lateral section, the lateral section including a niche portion that projects over the base section and is at least about 0.5 inches above the base section; wherein the base section of each component is configured such that the base sections of the two components can be connected such that the components are in opposing relation to each other to form the drywall track.

2. The system of claim 1, wherein the base sections can be joined together to form the drywall track.

3. The system of claim 1, wherein the base sections abut each other to form the drywall track.

4. The system of claim 1, wherein the base sections are complementarily sized such that the width of the drywall track can be adjusted by sliding one base section over a second base section.

5. The system of claim 1, wherein each component includes at least one drainage aperture.

6. The system of claim 5, wherein the at least one drainage aperture is located at least in part on the base section of each component.

7. The system of claim 5, wherein the at least one drainage aperture is located at the junction between the base section and the lateral section.

8. The system of claim 1, wherein each component includes at least one vent.

9. The system of claim 8, wherein the lateral section of each component includes the at least one vent.

10. The system of claim 1, wherein the niche portion is at least 1 inch above the base section.

11. The system of claim 1, wherein the niche portion is at least 1.5 inches above the base section.

12. The system of claim 1, wherein the niche portion is at least 2 inches above the base section.

13. The system of claim 1 consisting essentially of:

the base section and the lateral section.

14. A drywall track component consisting of:

a single planar base section substantially perpendicular to a single lateral section, the lateral section including a niche portion that projects over the base section and is at least about 0.5 inches above the base section.

* * * * *